US009445666B2

(12) United States Patent
Chang

(10) Patent No.: US 9,445,666 B2
(45) Date of Patent: Sep. 20, 2016

(54) SHELF WITH INTERLAYERS

(71) Applicant: Wen-Tsung Chang, Taichung (TW)

(72) Inventor: Wen-Tsung Chang, Taichung (TW)

( * ) Notice: Subject to any disclaimer, the term of this patent is extended or adjusted under 35 U.S.C. 154(b) by 0 days.

(21) Appl. No.: 14/482,713

(22) Filed: Sep. 10, 2014

(65) Prior Publication Data

US 2015/0076099 A1 Mar. 19, 2015

(30) Foreign Application Priority Data

Sep. 13, 2013 (CN) ..... 2013 2 0568347 U

(51) Int. Cl.

| | |
|---|---|
| ***A47F 7/08*** | (2006.01) |
| ***A47F 5/14*** | (2006.01) |
| ***A47B 43/00*** | (2006.01) |
| ***A47B 47/00*** | (2006.01) |
| ***A47B 57/00*** | (2006.01) |
| ***A47F 5/01*** | (2006.01) |
| ***A47B 55/02*** | (2006.01) |
| ***A47F 5/13*** | (2006.01) |
| ***A47B 87/02*** | (2006.01) |
| ***A47F 5/16*** | (2006.01) |
| ***A47F 5/00*** | (2006.01) |

(52) U.S. Cl.

CPC ..... *A47B 47/0033* (2013.01); *A47B 47/0008* (2013.01); *A47B 47/0016* (2013.01); *A47B 55/02* (2013.01); *A47B 87/0207* (2013.01); *A47B 87/0276* (2013.01); *A47F 5/0018* (2013.01); *A47F 5/01* (2013.01); *A47F 5/132* (2013.01); *A47F 5/16* (2013.01)

(58) Field of Classification Search

CPC ..... A47B 47/0033; A47B 47/0016; A47B 47/0008; A47B 55/02; A47B 45/00; A47B 47/00; A47B 47/0025; A47B 47/0091; A47B 47/02; A47B 47/021; A47B 47/025; A47B 61/04; A47B 57/04; A47B 57/06; A47B 87/02; A47B 87/007; A47B 87/005; A47B 87/008; A47B 87/0207; A47B 87/0276; A47B 5/132; A47B 5/01; A47B 5/0018; A47B 5/0025; A47B 5/0031; A47B 5/0043; A47B 5/0062; A47B 5/10; A47B 5/13; A47B 5/16; A47B 7/08; A47B 87/00; A47B 87/0284; A47B 87/0215; A47B 47/047

USPC ..... 211/186, 189, 188, 194, 182, 36, 181.1; 312/107, 108, 111, 265.1–265.4, 312/257.1, 4–6, 351; 403/169–176, 403/217–219; 220/4.28, 4.33

See application file for complete search history.

(56) References Cited

U.S. PATENT DOCUMENTS

| | | | | |
|---|---|---|---|---|
| 1,281,856 | A * | 10/1918 | Shaw | 446/112 |
| 3,891,335 | A * | 6/1975 | Feil | 403/173 |
| 3,913,289 | A * | 10/1975 | Recker | 312/140 |
| 3,955,510 | A * | 5/1976 | Kinik et al. | 108/192 |
| 4,493,425 | A * | 1/1985 | Yoshida | 211/189 |
| 5,121,526 | A * | 6/1992 | Burkard et al. | 24/336 |
| 5,466,057 | A * | 11/1995 | Blankenburg | 312/108 |
| 5,715,956 | A * | 2/1998 | Yoshida | 211/182 |
| 6,732,858 | B1 * | 5/2004 | Chang Ou | 206/278 |

(Continued)

*Primary Examiner* — Jennifer E Novosad

(74) *Attorney, Agent, or Firm* — Che-Yang Chen; Law Offices of Scott Warmuth

(57) ABSTRACT

A shelf with interlayers may include a shelf made by a plurality of connectors and panels, wherein both sides of the panel has at least one connecting portion and connecting unit, and connecting unit has a connecting groove corresponding to the panel, and the connecting groove is configured to engage with auxiliary panels to increase the variability of using an inner space of the shelf.

4 Claims, 14 Drawing Sheets

(56) References Cited

U.S. PATENT DOCUMENTS

| | | | | |
|---|---|---|---|---|
| D506,613 | S * | 6/2005 | Gusdorf | D3/304 |
| D555,399 | S * | 11/2007 | Tsai et al. | D6/675.1 |
| 7,963,404 | B2 * | 6/2011 | Shang | 211/36 |
| 8,955,928 | B2 * | 2/2015 | Cheng | 312/265.2 |
| 2004/0131416 | A1 * | 7/2004 | Wu et al. | 403/170 |
| 2004/0134869 | A1 * | 7/2004 | Yang et al. | 211/181.1 |
| 2009/0020669 | A1 * | 1/2009 | Wang | 248/220.1 |
| 2009/0166356 | A1 * | 7/2009 | Tsai | 220/4.01 |
| 2010/0277045 | A1 * | 11/2010 | Cheng | 312/263 |
| 2015/0069894 | A1 * | 3/2015 | Shang et al. | 312/265.5 |
| 2015/0076099 | A1 * | 3/2015 | Chang | 211/186 |

* cited by examiner

SHELF WITH INTERLAYERS

FIELD OF THE INVENTION

The present invention is related to shelf, and more particularly to a shelf with an interlayer structure.

BACKGROUND OF THE INVENTION

A conventional shelf includes connections and panels compose together to form a frame of a receiving space, which can provide storage function for the users. However, the storage space for conventional shelves is most likely rectangle, and if the user wants to increase the storage space, he/she can only stack up the shelves. Moreover, it is not adjustable, less practical, without the stability of structural strength, which may decrease the user's interest of purchasing the product. Therefore, there remains a need for a new and improved shelf interlayer structure to overcome the problems stated above.

SUMMARY OF THE INVENTION

The storage space for conventional shelves is most likely rectangle, and if the user wants to increase the storage space, he/she can only stack up the shelves. Moreover, it is not adjustable, less practical, without the stability of structural strength, which may decrease the user's interest of purchasing the product.

The present invention provides an interlayer structure in a shelf, which includes a shelf having a plurality of connectors and panels, wherein both sides of the panel at least has a corresponding connecting portion and connecting unit. Therefore, through the connecting unit on the panel or the connectors engaging with auxiliary panels, the interior structure of the shelf becomes adjustable to increase practicability of the shelf. Furthermore, the interior auxiliary panels can increase the structural strength and enhance the stability of the structure.

Comparing with the conventional structure, both sides of the panel at least has a corresponding connecting portion and connecting unit. Therefore, through the connecting unit on the panel or the connectors engaging with auxiliary panels, the interior structure of the shelf becomes adjustable and the space of the shelf can be divided to at least two receiving spaces. Furthermore, the interior auxiliary panels can increase the structural strength and enhance the stability of the structure.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
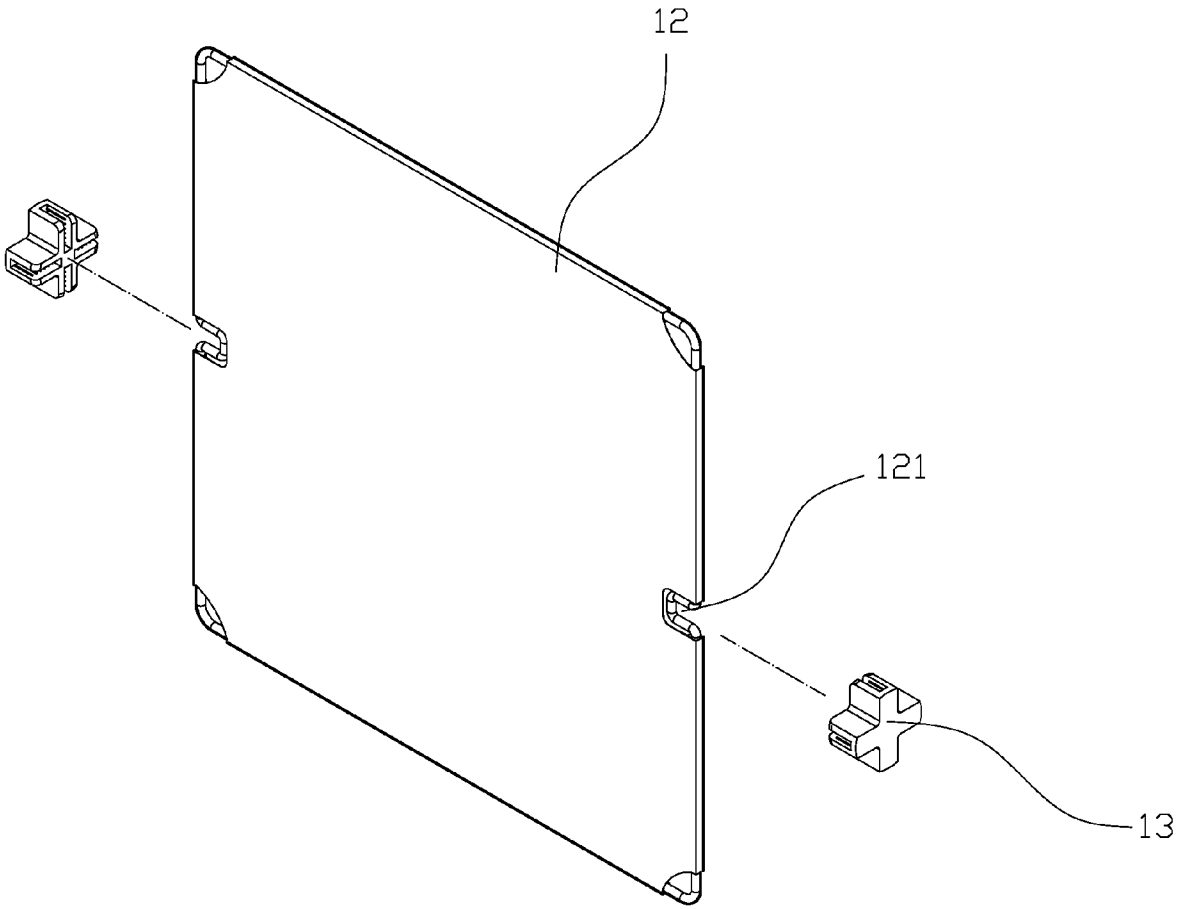
FIG. 1 illustrates a three-dimensional view of the present invention.
Figure 2:
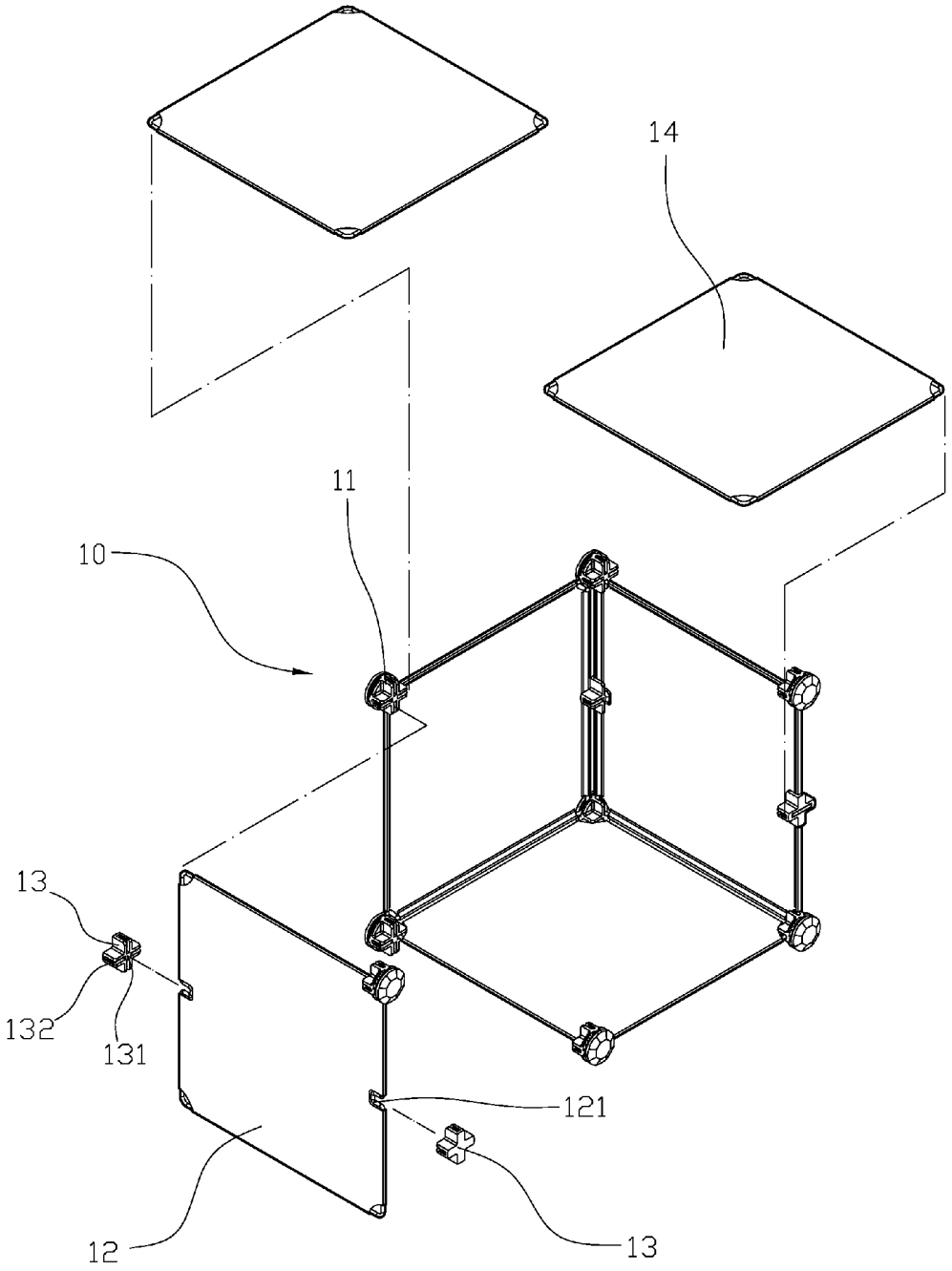
FIG. 2 illustrates a first exploded view of shelf of the present invention.
Figure 3:
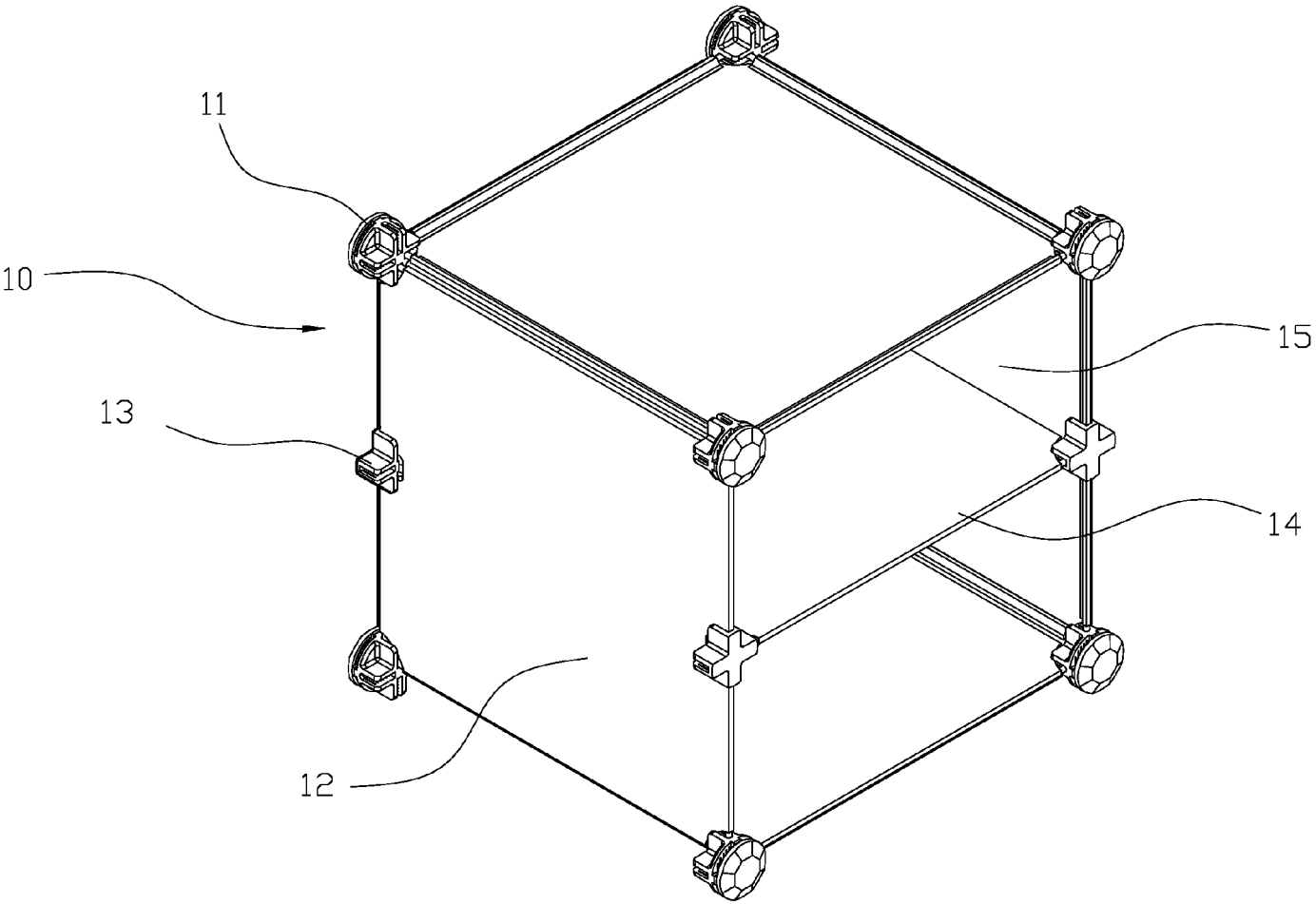
FIG. 3 illustrates a first three-dimensional view of shelf of the present invention.
Figure 4:
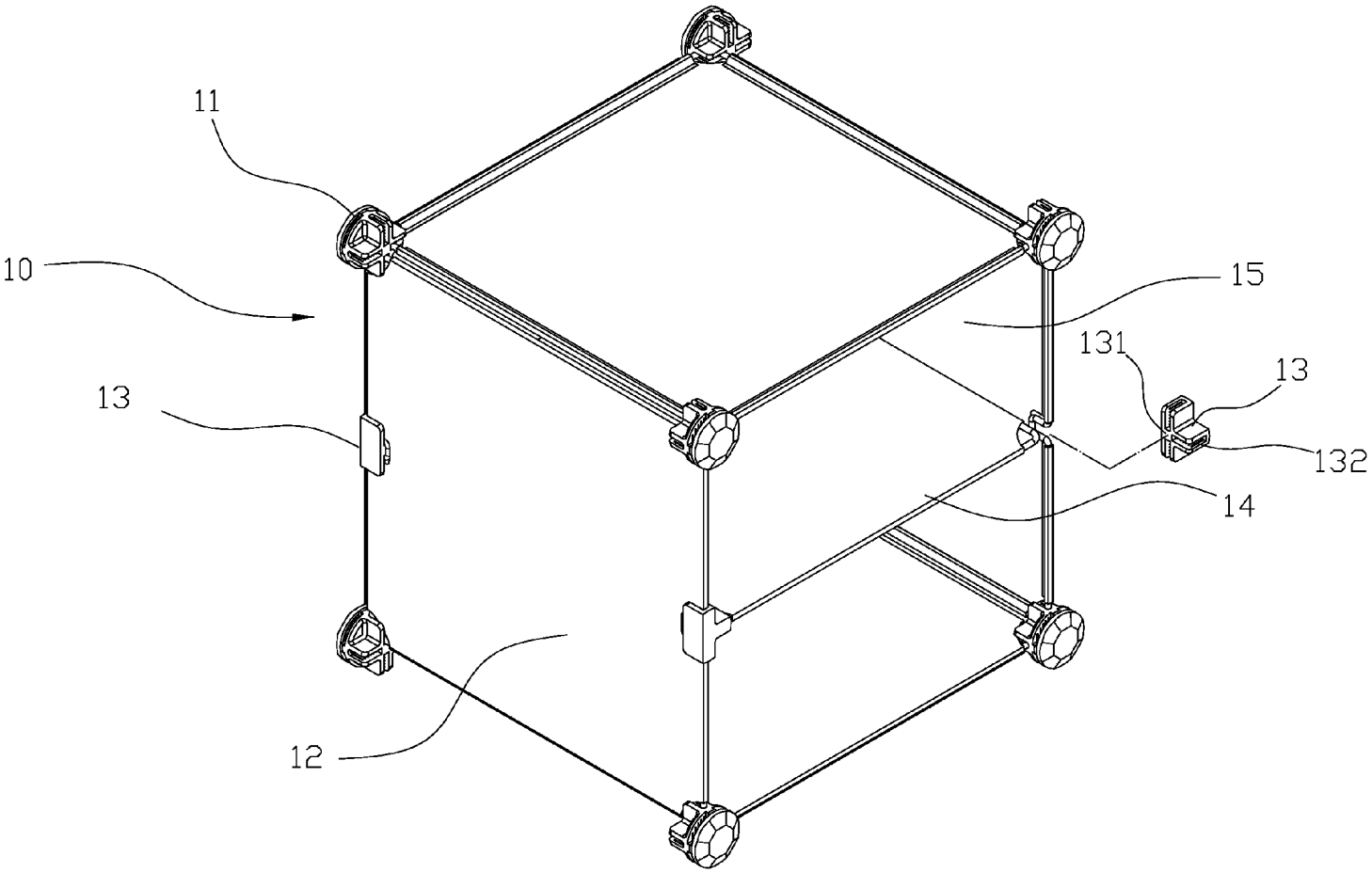
FIG. 4 illustrates a schematic view of the connector of another embodiment in the present invention.

In order to further understand the goal, characteristics and effect of the present invention, a number of embodiments along with the drawings are illustrated as following:

Referring to FIGS. 1 to 3, the interlayer structure of a shelf may includes a shelf 10, having a plurality of connectors 11 and panels 12, wherein both sides of the panels 12 have at least one connecting portion 121 and a connecting unit 13. The connecting portion 121 on the panel 12 forms a U-shaped groove, and the connecting unit 13 has filled sealing structure in the center. Therefore, the connecting unit 13 can be disposed on both sides of the panels 12 through connecting portion 121. The connecting unit 13 has a connecting groove 132 corresponding to the panel 12. Furthermore, the connecting portion 121 of the connecting unit 13 forms a cross shape. Thereby, setting auxiliary panel 14 on connecting portion 13, which is on panel 12, to make auxiliary panel perpendicular to both sides of panel 12, and make interior shelf 10 has two storage space 15 by auxiliary panel 14. It can make shelf 10 has two equal and parallel storage spaces 15, moreover, it makes shelf 10 more adjustable, enhance the practicability, furthermore, the connecting unit 13 and the connecting groove 132 can form a T-shape with a single shelf 10 (Also referring to FIG. 4), so that shelf 10 will not have projection and is safe to use.

Figure 5:
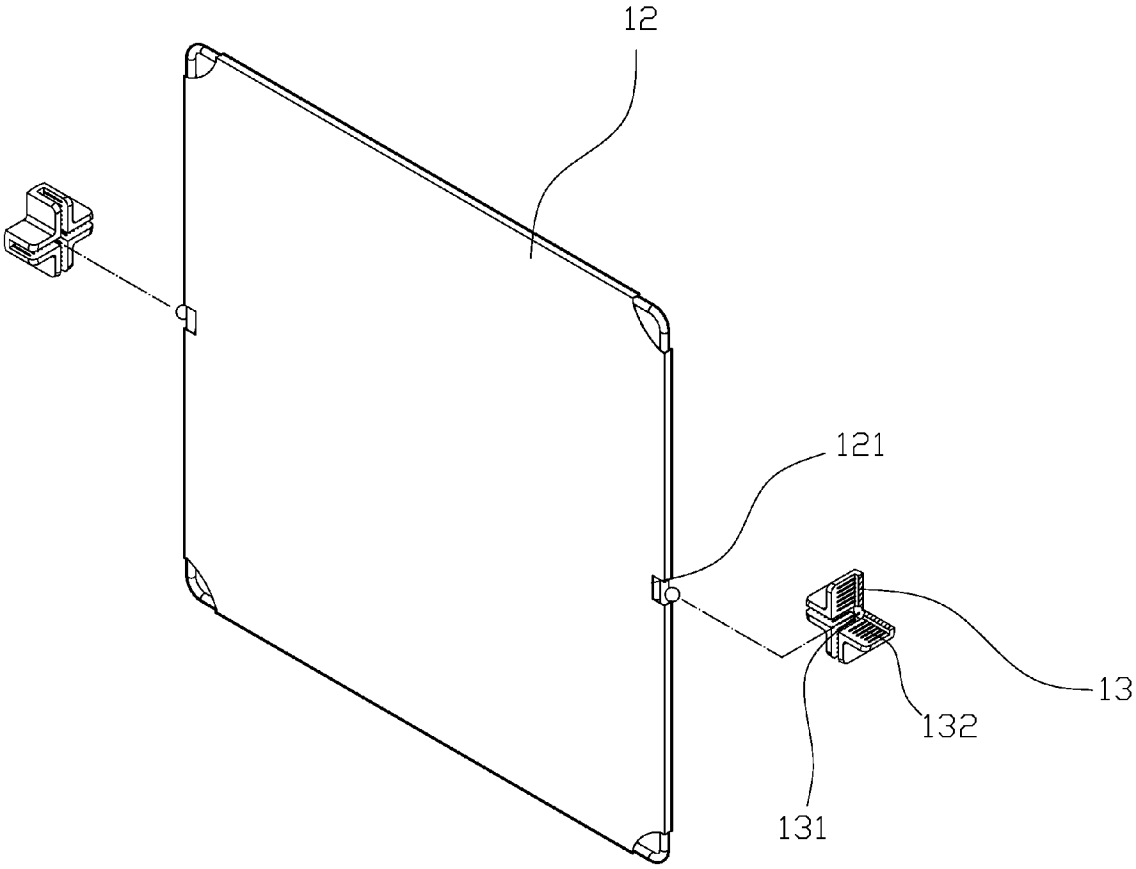
FIG. 5 illustrates a schematic view of the connecting portion of the panel of another embodiment in the present invention.

Another embodiment of the panel 12, referring to FIG. 5, the combination unit 121 corresponding to the both sides of panel 12 forms a convex spherical shape, and make combination unit 13's center has hollow scarf joint part 131, thereby composing scarf joint part 131 of connecting unit 13 and combination 121, and utilizing the connecting groove 132 with auxiliary panel 14 to change the storage space of the shelf, which enhance its practicability.

Figure 6:
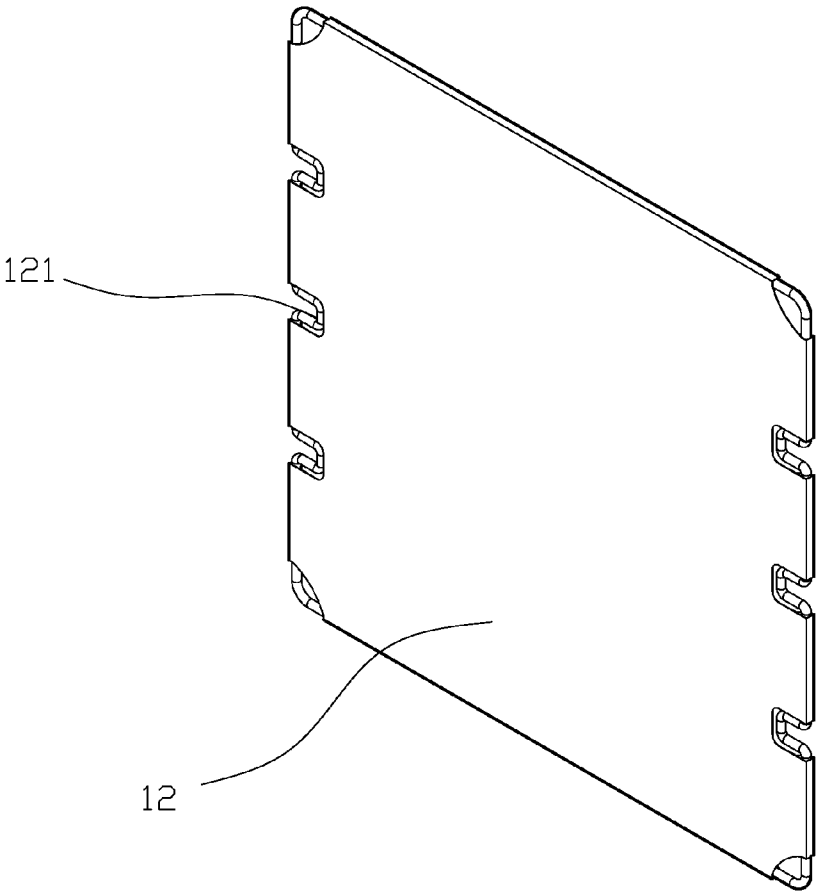
FIG. 6 illustrates three connecting portions on both sides of the panel in the present invention.

Furthermore, both sides of the panel 12 has 2-3 corresponding connecting portion 121 (Also referring to FIG. 6), and respectively provide connecting unit 13 to make the shelf 10 composed by panel 12 and connectors 11 can adjust auxiliary panel with its need, and increase the variability of storage space 15 of the shelf 10.

Figure 7:
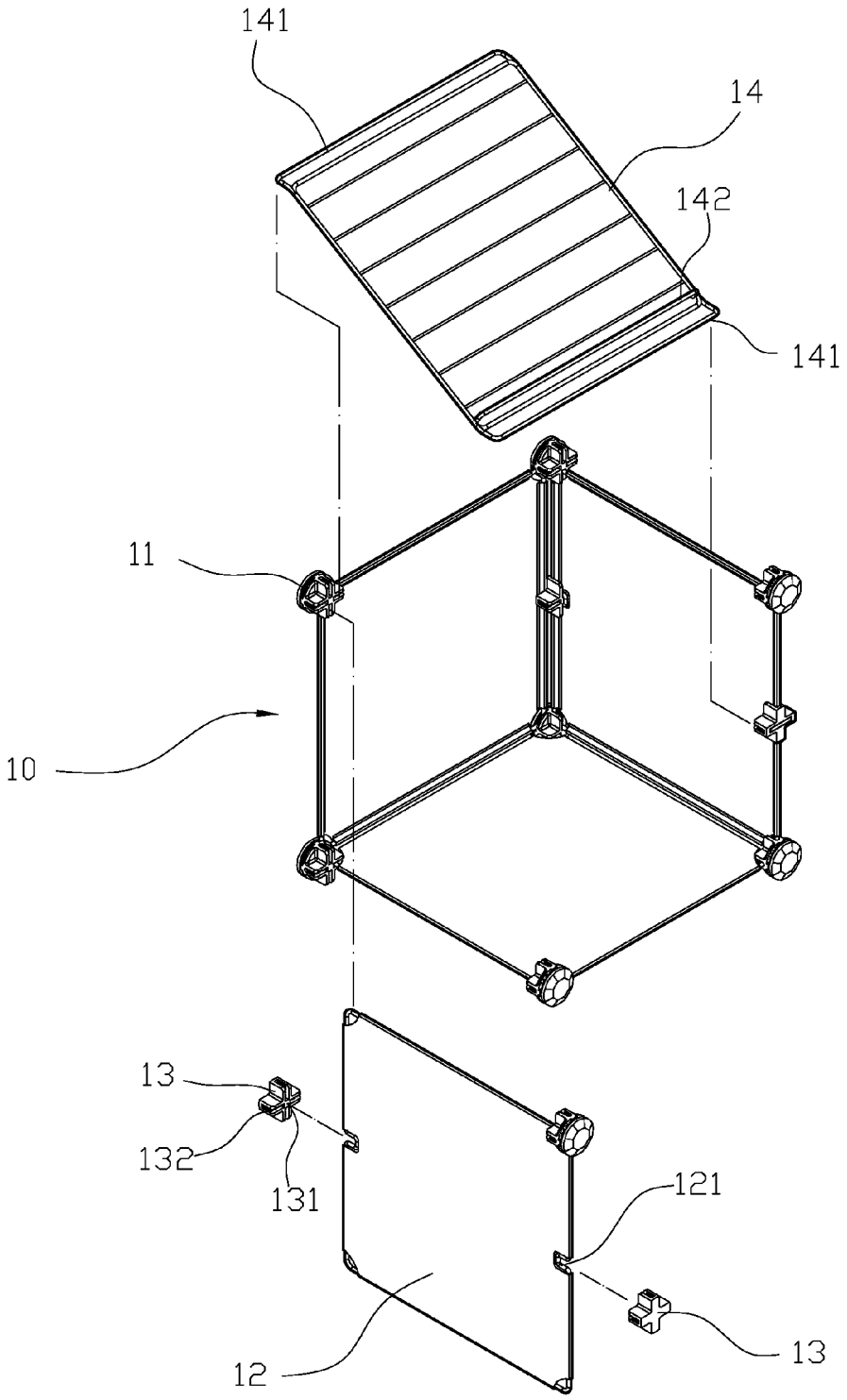
FIG. 7 illustrates an exploded view of shelf of another embodiment in the present invention.
Figure 8:
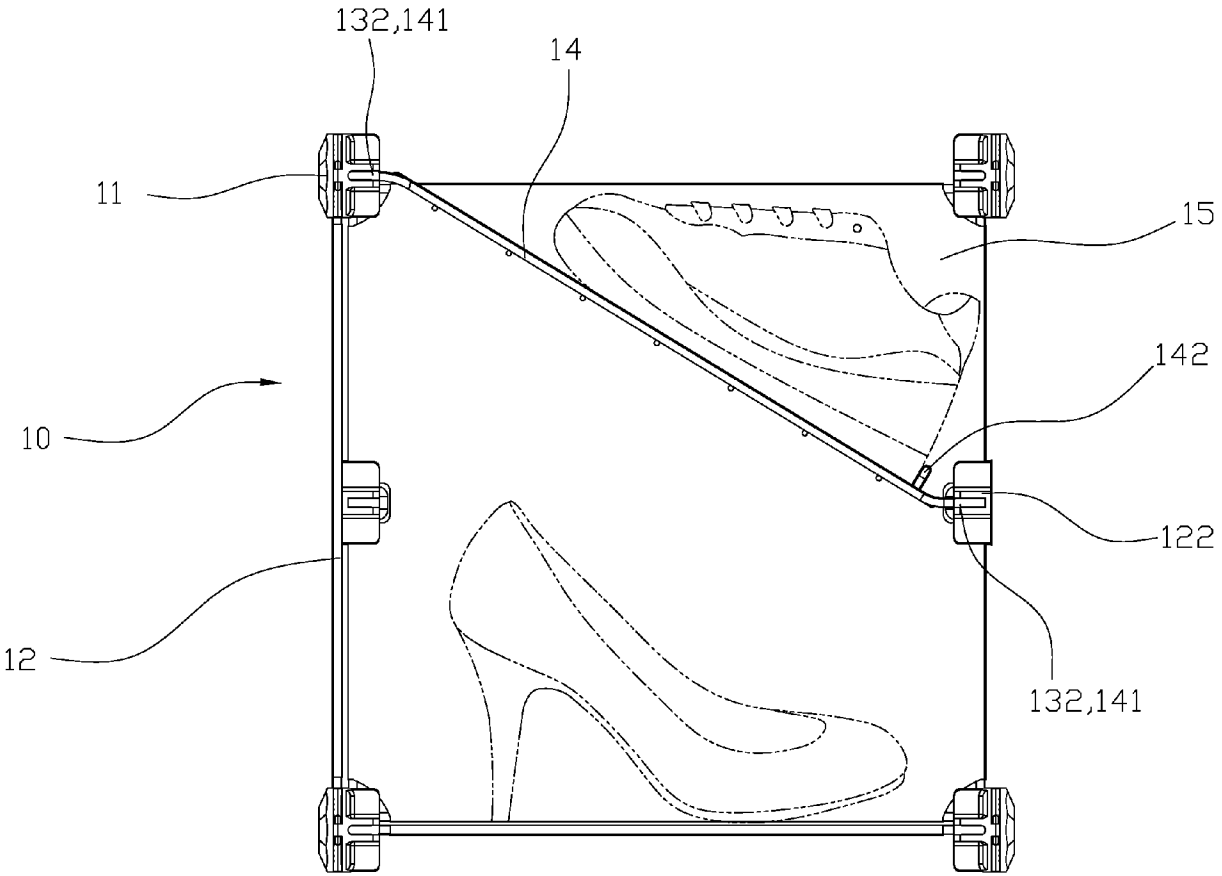
FIG. 8 illustrates a schematic view of shelf of another embodiment in the present invention.

Also the auxiliary panel 14 can have a swash plate structure, referring to FIG. 7-8, both sides of the auxiliary panel 14 is bent parallel to the sealing structure 141, and set a stopper part 142 on the side-end of sealing structure 141. Side-end sealing structure 141 of auxiliary panel can joint on the connectors 11 of shelf 10, and another side-end sealing structure 141 can joint on connecting unit 13 of panel 12. It can make auxiliary panel 14 form a swash plate structure in the shelf 10, which can let user to put the shoes, the stopper part 142 set on the end of auxiliary panel 14 can restrict shoes to slip.

Figure 9:
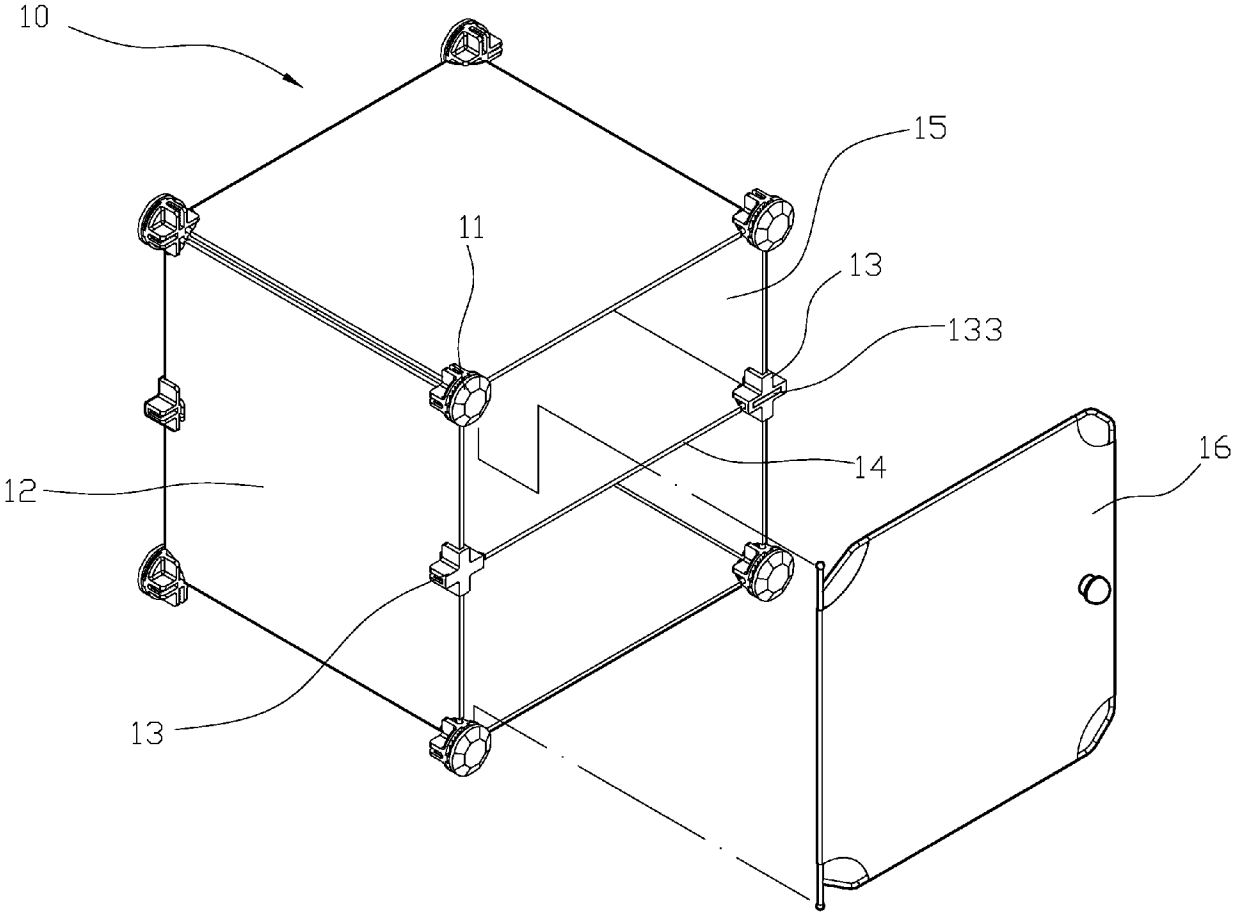
FIG. 9 illustrates the shelf with a door in the present invention.
Figure 10:
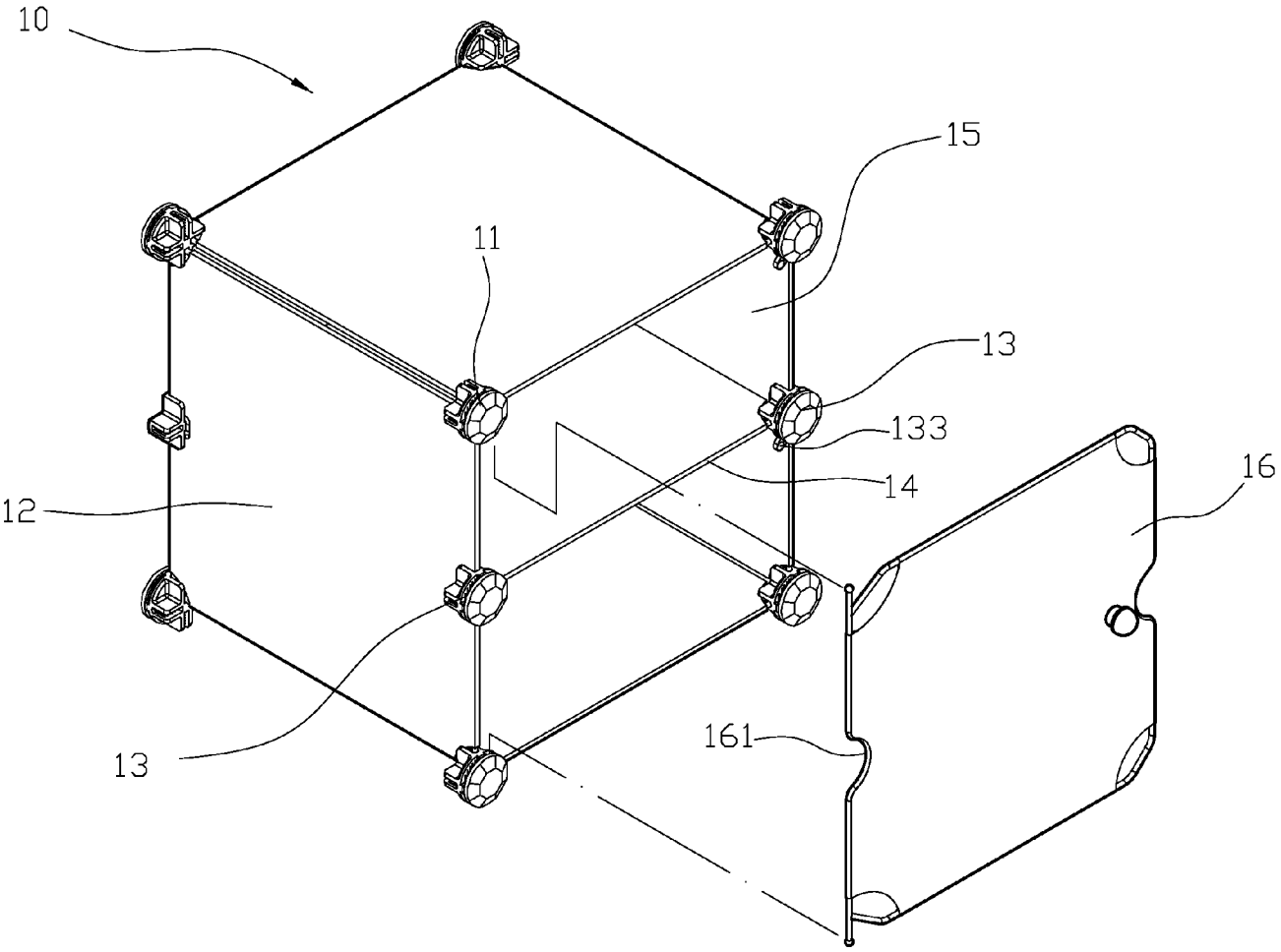
FIG. 10 illustrates a schematic view of the shelf with the door in the present invention.
Figure 11:
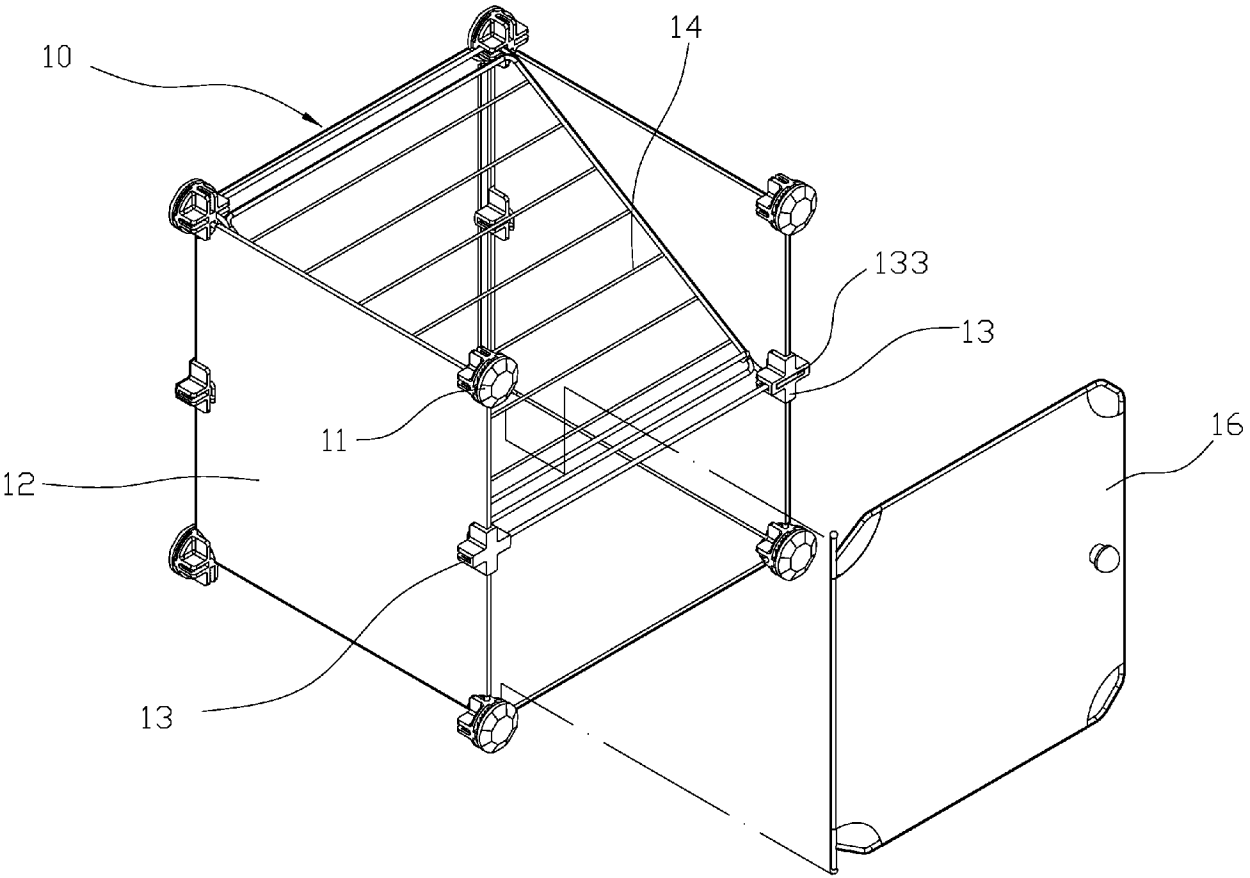
FIG. 11 illustrates a schematic view of the shelf with the door in the present invention in another embodiment.
Figure 12:
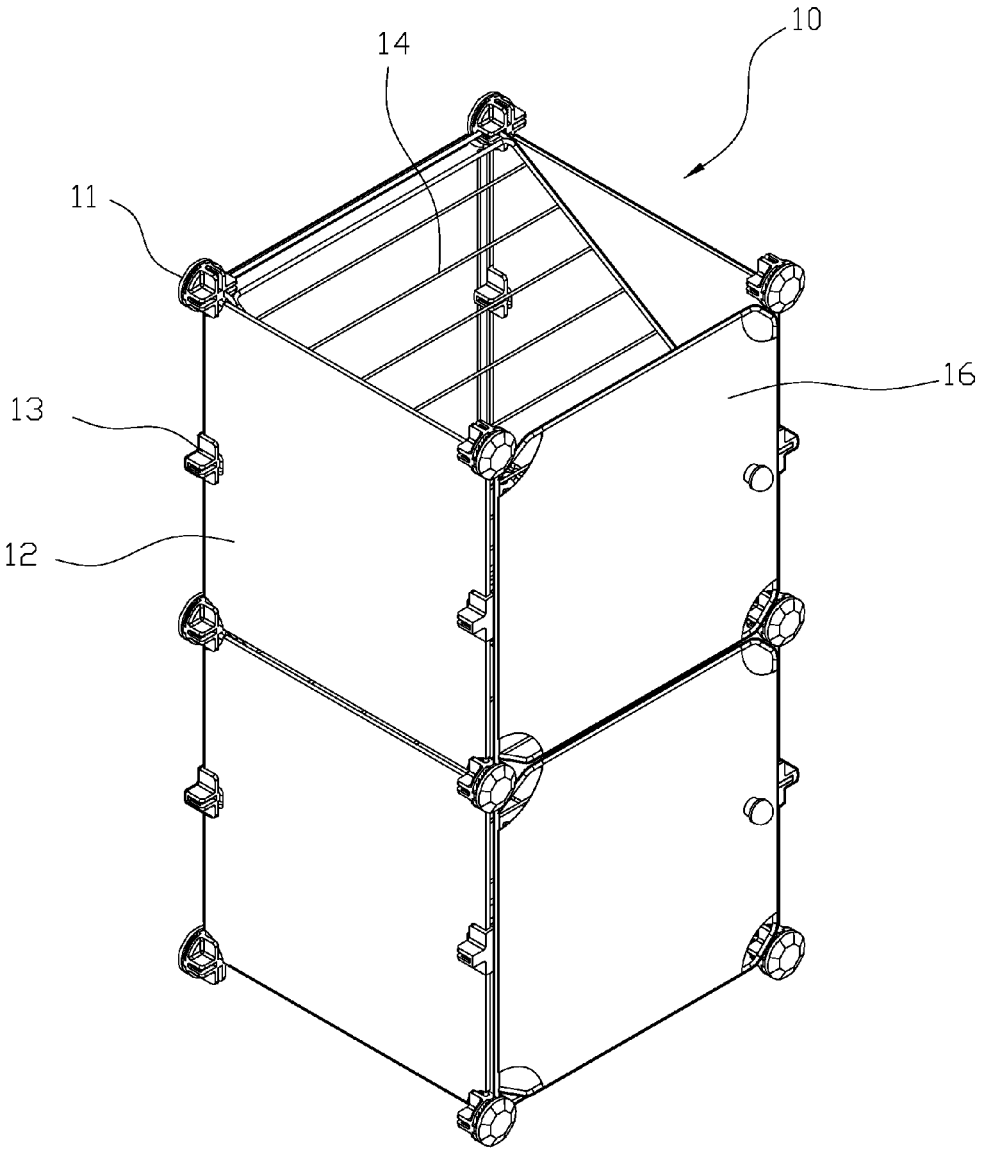
FIG. 12 illustrates a first embodiment of a cabinet including a plurality of the shelves in the present invention.
Figure 13:
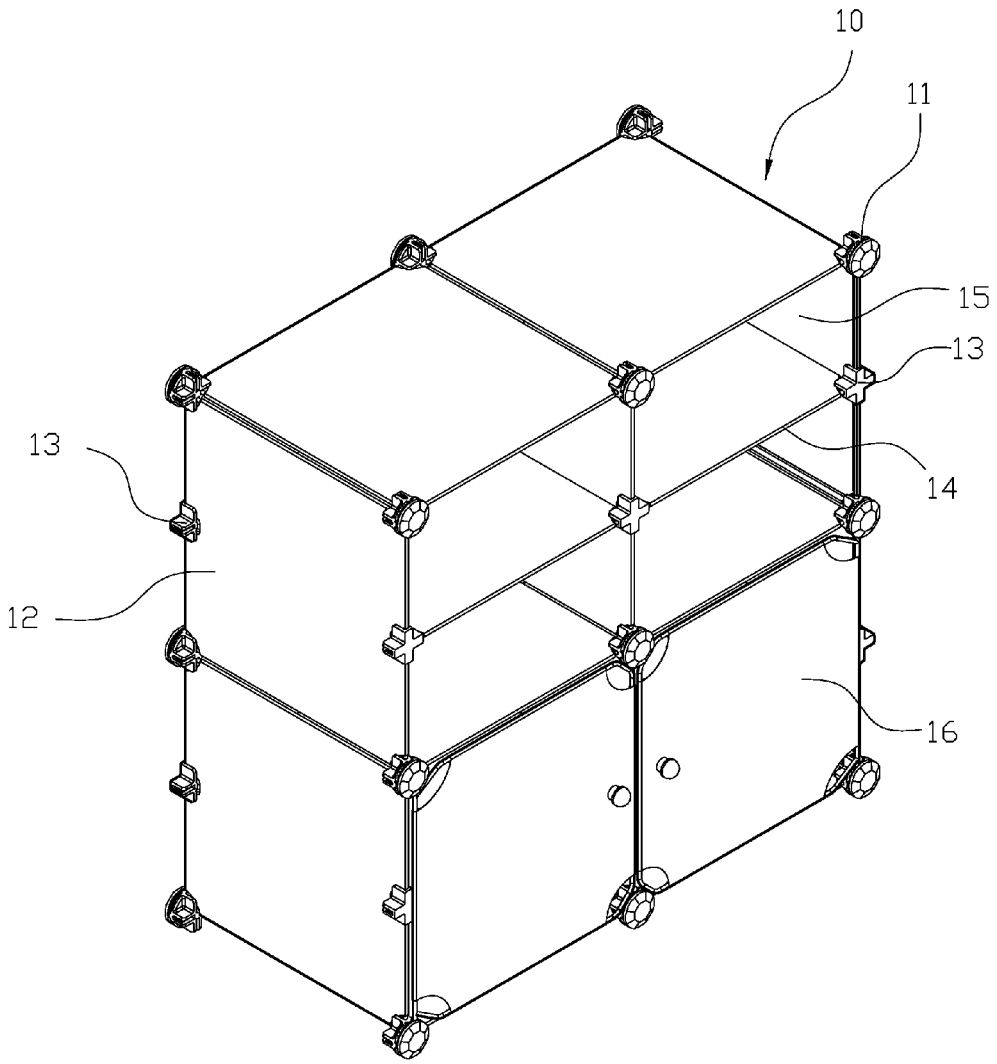
FIG. 13 illustrates a second embodiment of a cabinet including a plurality of the shelves in the present invention.
Figure 14:
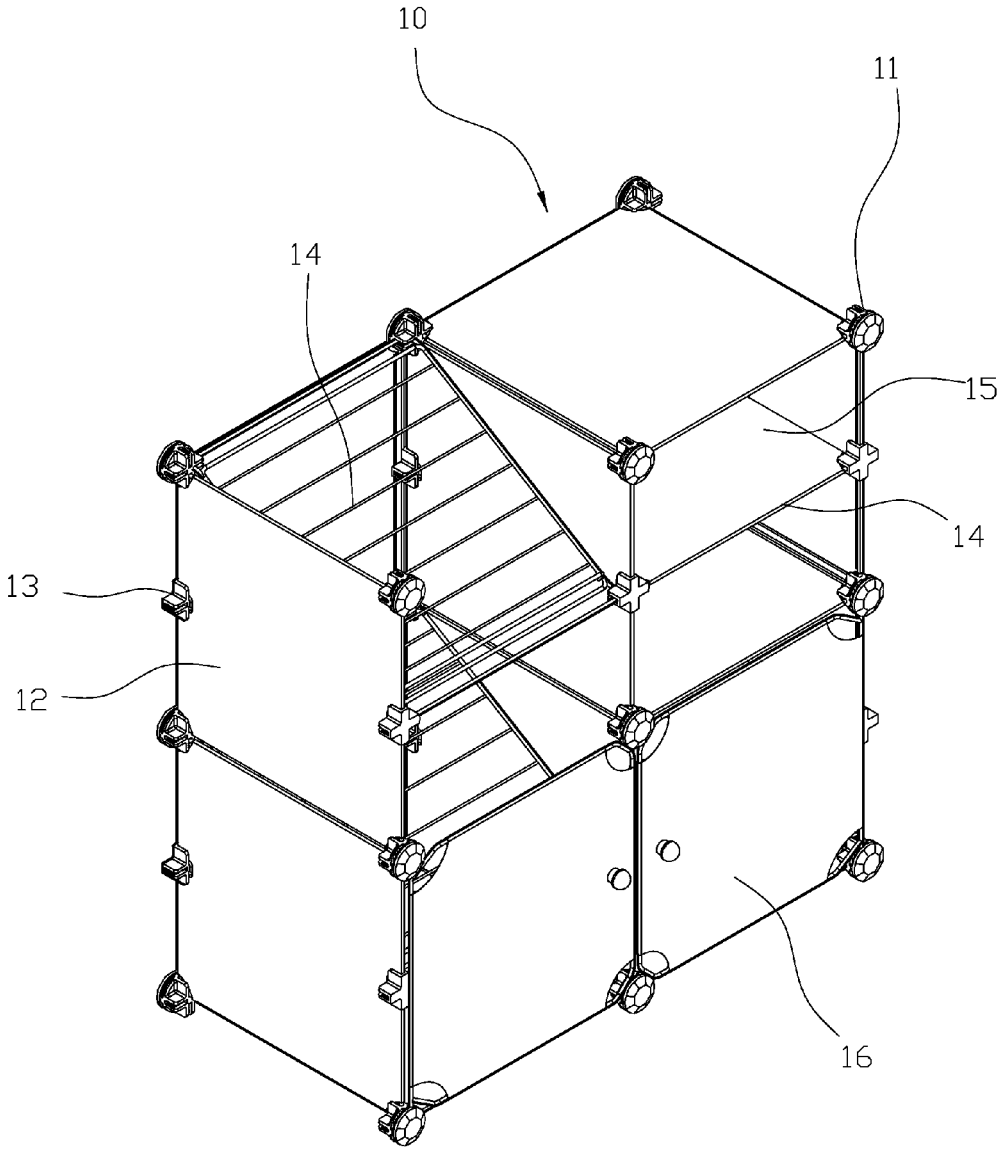
FIG. 14 illustrates a third embodiment of a cabinet including a plurality of the shelves in the present invention.

The structure of the embodiment of the present invention, referring to FIG. 9, the shelf 10 can set door 16 with connectors 11, and the connecting unit 13 of panel 12 can joint with magnetic part 133, which the connecting unit 13 will attract corresponding magnetic part 133 and make the door 16 close well. The connecting unit 13 has the same structure as connectors 11 (Also referring to FIG. 10), and the door 16 has the concave arc dodge for the assemblies 13 on both sides.

Shelf 10 can utilize connectors 11 and connecting unit 13 to make composition, referring to FIG. 11-14, it can compose a cabinet, and this cabinet can adjust its structure by the function needed. For example, multilayer shelf, multilayer shelf with door, shoes closet, shelf with door, or the shelf with door, interlayer and shoes storage. The variability of the adjustable shelf can enhance its practicability.

According to the embodiments mentioned-above can get the conclusions: The present invention set connecting portion 13 on both sides of panel 12, and respectively provide connecting unit 13 to make the shelf 10 composed by panel 12 and connectors 11 can adjust auxiliary panel with its need, which can make shelf 10 have at least two storage space, and increase the variability of storage space 15 of the shelf 10. Furthermore, interior auxiliary panels can increase the structural strength and enhance the stability of the structure.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A shelving apparatus comprising a plurality of connectors and panels which are arranged to define a receiving space surrounded by the panels, and two of the panels facing each other defined as side panels, each of the side panels defining a peripheral edge, wherein each of the side panels has at least one U-shaped connecting portion on each of two parallel sides thereof extending inwardly from the peripheral edge and a connecting unit engages with said connecting portion, wherein the connecting unit has a plurality of connecting grooves, and an auxiliary panel with four corner connecting edges are inserted into the receiving space perpendicular to the side panels and the corner connecting edges are engaged with the connecting grooves of corresponding connecting units to secure the auxiliary panel thereto.

2. The shelving apparatus of claim 1, wherein the connecting grooves in each connecting unit form a cross shape.

3. The shelving apparatus of claim 1, wherein the connecting unit is T-shaped.

4. The shelving apparatus of claim 1, wherein each panel has four corners and each of the four corners is secured by the connector; one side of a door is pivotally connected with two connectors located at an upper and lower front corner of the shelving apparatus, and a magnetic unit is disposed on the connecting unit, so when the door is closed, the other side of the door is secured through a magnetic force.

* * * * *